US009216497B2

(12) United States Patent
Lai Li

(10) Patent No.: US 9,216,497 B2
(45) Date of Patent: Dec. 22, 2015

(54) POSITIONING TORQUE MECHANISM FOR TORQUE WRENCH

(71) Applicant: Yu-Lan Lai Li, Taichung (TW)

(72) Inventor: Yu-Lan Lai Li, Taichung (TW)

( * ) Notice: Subject to any disclaimer, the term of this patent is extended or adjusted under 35 U.S.C. 154(b) by 255 days.

(21) Appl. No.: 13/966,348

(22) Filed: Aug. 14, 2013

(65) Prior Publication Data

US 2015/0047477 A1 Feb. 19, 2015

(51) Int. Cl.
*B25B 23/12* (2006.01)
*B25B 23/142* (2006.01)

(52) U.S. Cl.
CPC ..... *B25B 23/1427* (2013.01)

(58) Field of Classification Search
CPC ..... B25B 23/142; B25B 23/1427
USPC ..... 81/473, 475, 476, 478, 480, 483
See application file for complete search history.

(56) References Cited

U.S. PATENT DOCUMENTS

| | | | | |
|---|---|---|---|---|
| 6,334,377 | B1 * | 1/2002 | Wu | 81/478 |
| 7,275,467 | B1 * | 10/2007 | Lee | 81/475 |
| 7,836,781 | B1 * | 11/2010 | Chen | 73/862.22 |
| 8,245,606 | B2 * | 8/2012 | Chiang | 81/483 |
| 8,479,620 | B2 * | 7/2013 | Chen | 81/478 |

* cited by examiner

*Primary Examiner* — Hadi Shakeri
(74) *Attorney, Agent, or Firm* — Alan D. Kamrath; Kamrath IP Lawfirm, P.A.

(57) ABSTRACT

A torque wrench comprising: a body, an extension, a torque mechanism, a handle, and a positioning torque mechanism. The positioning torque mechanism includes a pressing cap, a clutch ring, and a spring. The pressing cap has a boss and an orifice, the orifice has plural shoulders, between two spaced shoulders is defined a recess, the pressing cap has an elongated hole and a peg. The clutch ring has plural teeth and plural first limiting projections, each first limiting projection has a tilted end portion, and between two spaced first limiting projections is defined a first limit notch, the handle includes a hollow locking member, and the locking member has at least one protrusion, each protrusion has a tilted second limit notch and an inclined edge, between two spaced protrusions is defined a third limit notch; the spring has two ends abutting against the clutch ring and the fixing member.

6 Claims, 11 Drawing Sheets

POSITIONING TORQUE MECHANISM FOR TORQUE WRENCH

FIELD OF THE INVENTION

The present invention relates to a positioning torque mechanism for a torque wrench which is capable of adjusting a torque value which is outputted and maintains a torque value which is adjusted.

BACKGROUND OF THE INVENTION

A conventional torque wrench contains a rotatable controller for driving a screw rod of an extension of the torque wrench to rotate, and a sliding block screws with the screw rod and moves on the extension. When the sliding block is located at different positions, it forces a spring so as to adjust a torque value. However, after setting the torque value, the controller cannot be fixed, so the torque value is changed easily because the wrench vibrates or the controller is rotated unintentionally, such that when operating the torque wrench, the torque value cannot be marinated at a fixed value.

The present invention has arisen to mitigate and/or obviate the afore-described disadvantages.

SUMMARY OF THE INVENTION

The primary object of the present invention is to provide a positioning torque mechanism for a torque wrench in which after setting a desired torque value, the pressing cap of the positioning torque mechanism is pressed easily and quickly, and the handle cannot be rotated, hence the torque value cannot be changed.

Another object of the present invention is to provide a positioning torque mechanism for a torque wrench in which the handle is fixed without rotation so as to maintain a set torque value, thus operating the torque wrench at a fixed torque value.

To obtain the above objectives, a positioning torque mechanism for a torque wrench contains: a body, an extension, a torque mechanism, a handle, and a positioning torque mechanism.

The extension is hollow and is fitted into the handle, and the body is inserted into a front side of the extension, and the torque mechanism is inserted into a rear side of the extension, the torque mechanism includes a fixing member inserted into a screw rod, a plurality of blocks arranged around an outer rim of a rear side thereof, a slot defined between two spaced blocks, the positioning torque mechanism is placed into a rear side of the handle and connects with the fixing member, characterized in that:

the positioning torque mechanism includes a pressing cap, a clutch ring, and a spring, wherein the pressing cap has a boss defined at a predetermined position of an outer rim thereof and an orifice formed on a front end thereof, the orifice has plural shoulders arranged around an inner wall thereof and corresponding to the plurality of blocks, and between two spaced shoulders is defined a recess for corresponding to the slot, such that the pressing cap is retained with the plurality of blocks and the slot by ways of the orifice, and the pressing cap has an elongated hole defined on the outer rim thereof and a peg inserted into the elongated hole, the screw rod, and the handle so that the pressing cap slides frontward and backward on the rear side of the handle; the clutch ring is fitted on the outer rim of the pressing cap and has a plurality of teeth arranged around one end thereof and plural first limiting projections, each first limiting projection has a tilted end portion, and between two spaced first limiting projections is defined a first limit notch, the handle includes a hollow locking member formed on an inner wall thereof, and the locking member has at least one protrusion spaced apart, and each protrusion has a tilted second limit notch and an inclined edge which are arranged on an end portion of each protrusion, between two spaced protrusions is defined a third limit notch; the spring has two ends abutting against the clutch ring and the fixing member, such that the positioning torque mechanism is pressed to control the torque mechanism.

DETAILED DESCRIPTION OF THE PREFERRED EMBODIMENTS

Figure 1:
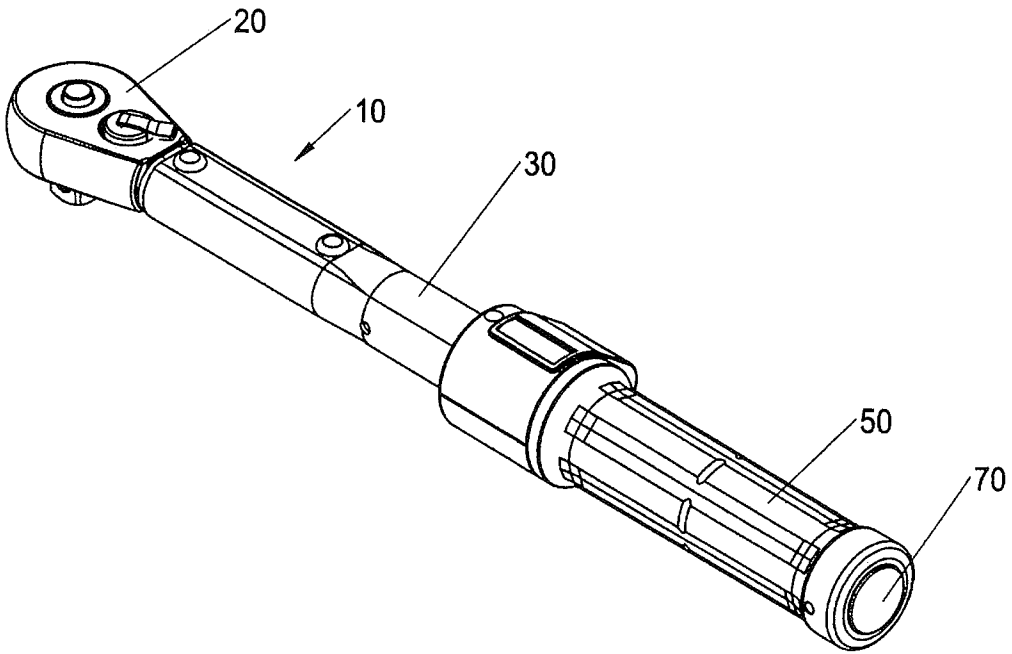
FIG. 1 is a perspective view showing the assembly of a torque wrench according to a preferred embodiment of the present invention.
Figure 2:
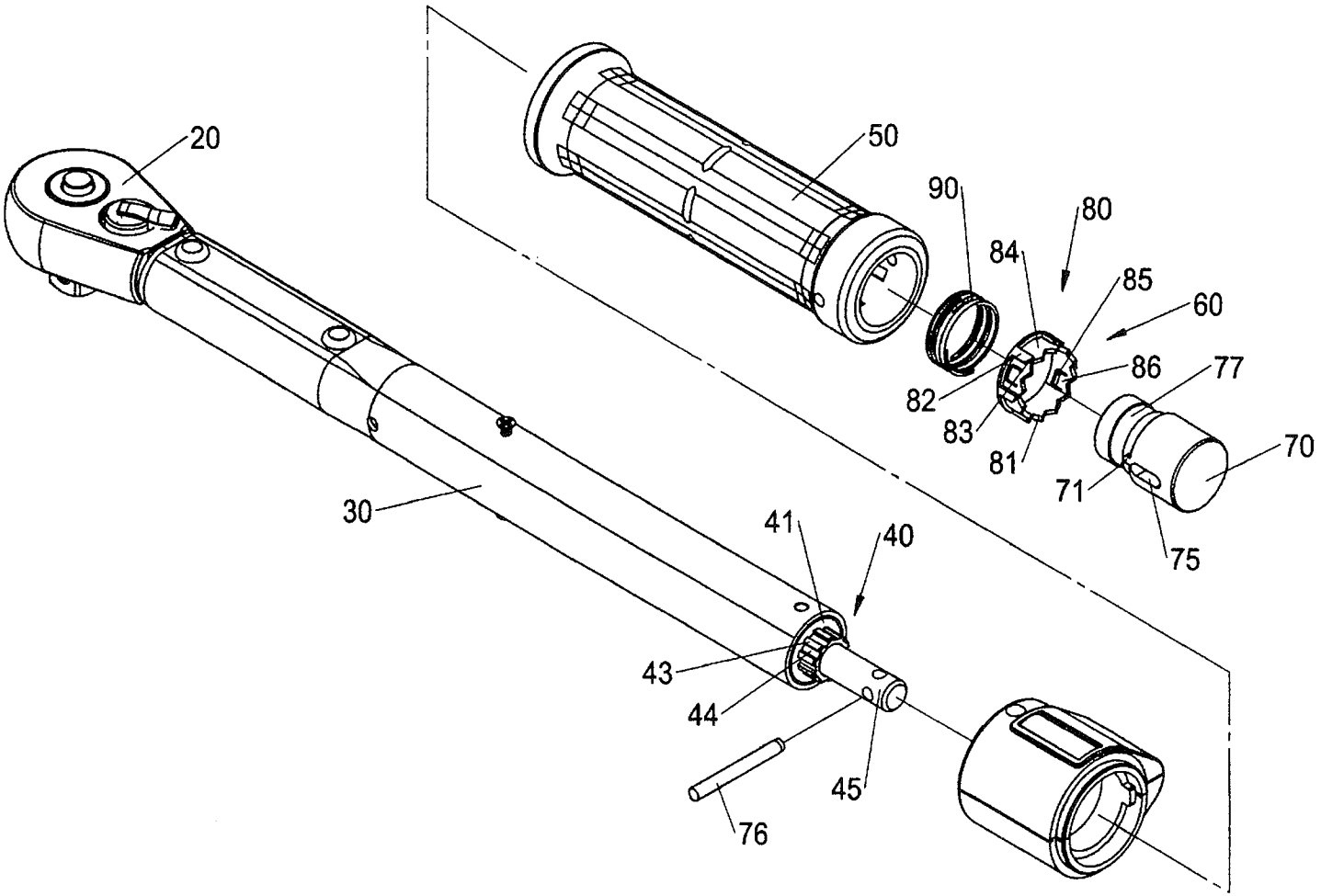
FIG. 2 is a perspective view showing the exploded component of the torque wrench according to the preferred embodiment of the present invention.
Figure 3:
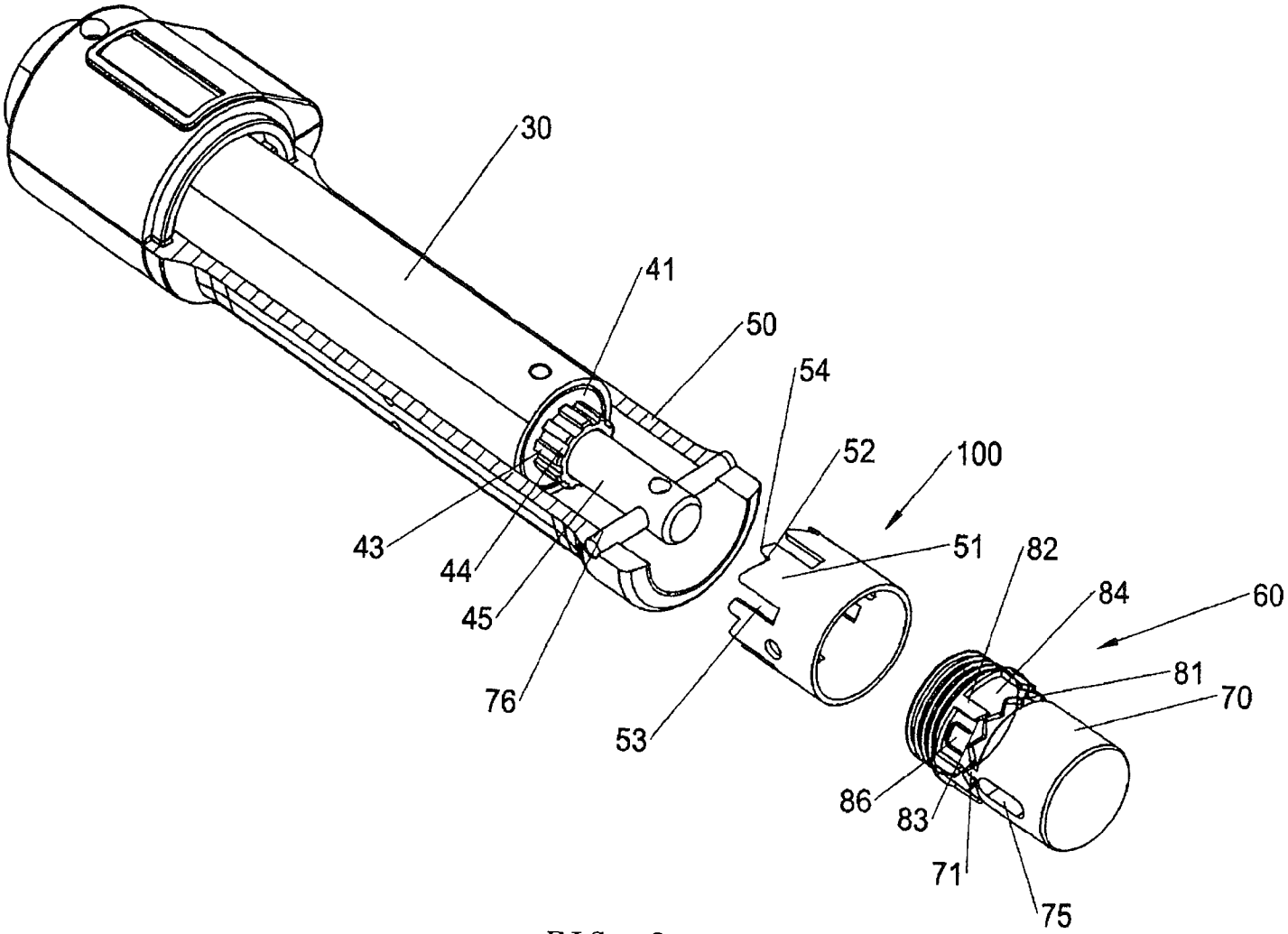
FIG. 3 is a perspective view showing the assembly of a positioning torque mechanism for the torque wrench according to the preferred embodiment of the present invention.
Figure 4:
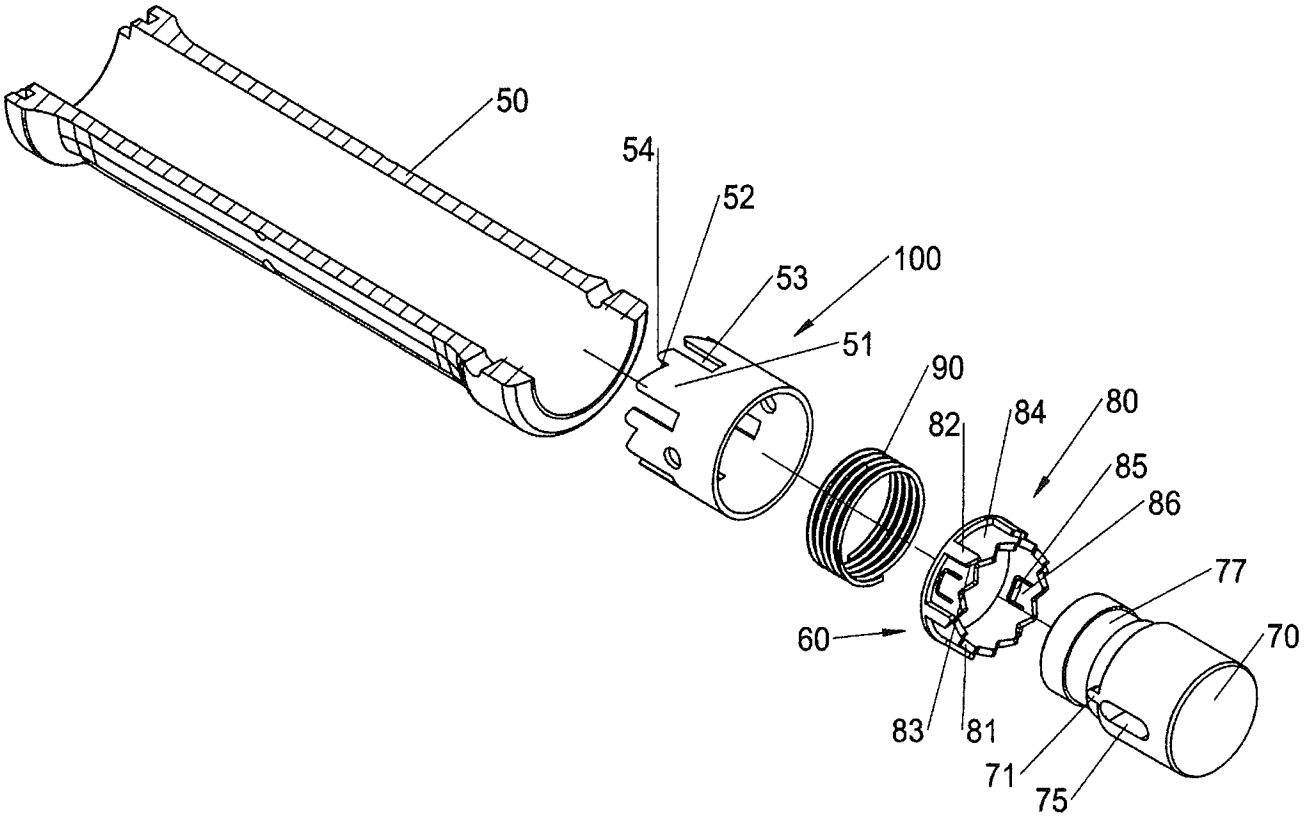
FIG. 4 is a perspective view showing the exploded components of the positioning torque mechanism for the torque wrench according to the preferred embodiment of the present invention.
Figure 5:
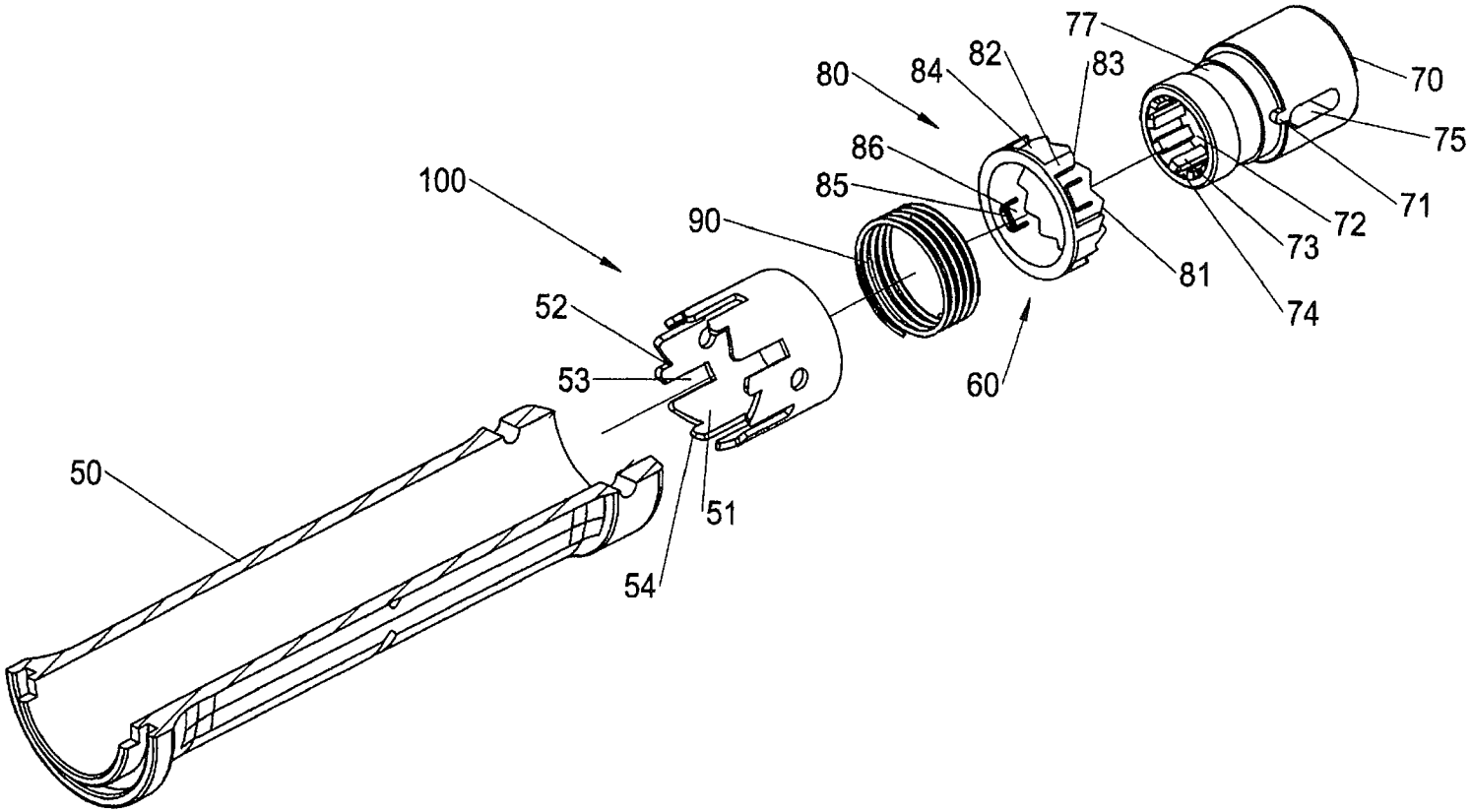
FIG. 5 is another perspective view showing the exploded components of the positioning torque mechanism for the torque wrench according to the preferred embodiment of the present invention.
Figure 6:
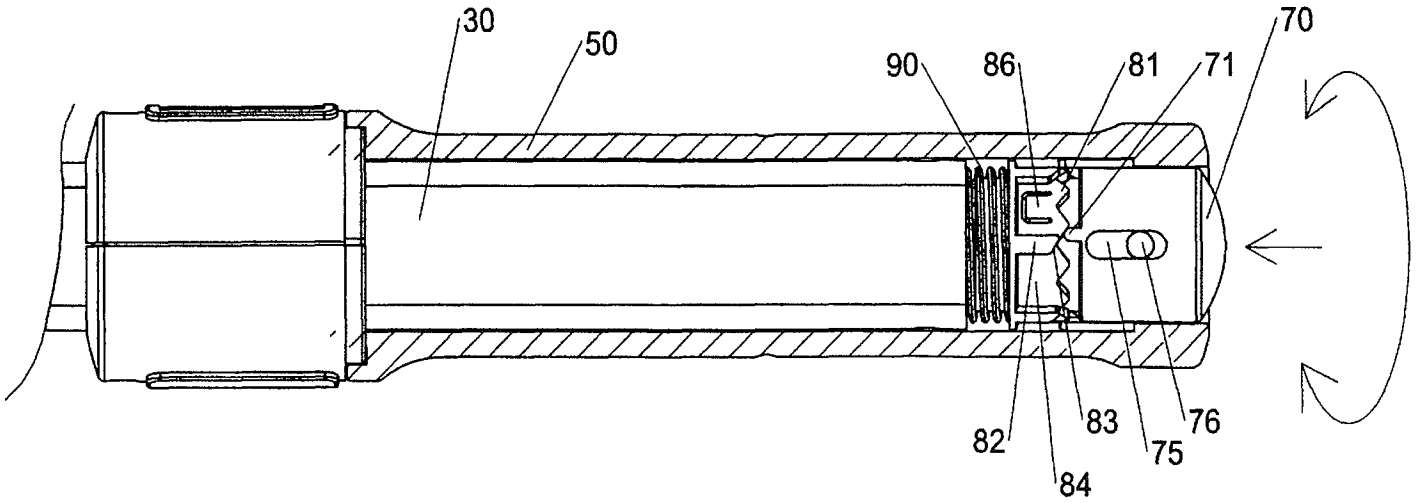
FIG. 6 is a cross sectional view showing the assembly of the positioning torque mechanism for the torque wrench according to the preferred embodiment of the present invention.
Figure 7:
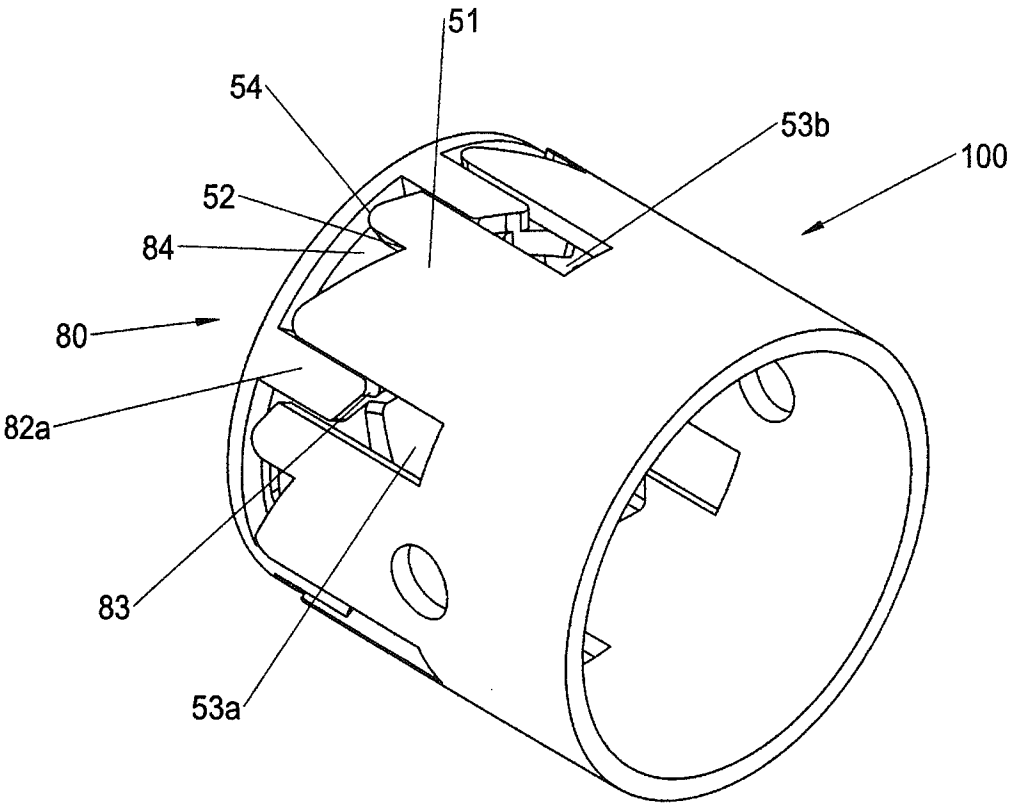
FIG. 7 is a perspective view showing the assembly of a clutch ring and a hollow locking member of the positioning torque mechanism for the torque wrench according to the preferred embodiment of the present invention.

With reference to FIGS. 1-6, a torque wrench 10 according to a preferred embodiment of the present invention comprises: a body 20, an extension 30, a torque mechanism 40, a handle 50, and a positioning torque mechanism 60.

The extension 30 is hollow and is fitted into the handle 50, and the body 20 is inserted into a front side of the extension 30, and the torque mechanism 40 is inserted into a rear side of the extension 30. The torque mechanism 40 includes a fixing member 41 inserted into a screw rod 45, a plurality of blocks 43 arranged around an outer rim of a rear side thereof, a slot 44 defined between two spaced blocks 43. The positioning torque mechanism 60 is placed into a rear side of the handle 50 and connects with the fixing member 41, wherein the positioning torque mechanism 60 includes a pressing cap 70, a clutch ring 80, and a spring 90. The pressing cap 70 has a boss 71 defined at a predetermined position of an outer rim thereof and an orifice 72 formed on a front end thereof, the orifice 72 has plural shoulders 73 arranged around an inner wall thereof and corresponding to the plurality of blocks 43, and between two spaced shoulders 73 is defined a recess 74 for corresponding to the slot 44, such that the pressing cap 70 is retained with the plurality of blocks 43 and the slot 44 by ways of the orifice 72, and the pressing cap 70 has an elongated hole 75 defined on the outer rim thereof and a peg 76 inserted into the elongated hole 75, the screw rod 45, and the handle 50 so that the pressing cap 70 slides frontward and backward on the rear side of the handle 50. The clutch ring 80 is fitted on the outer rim of the pressing cap 70 and has a plurality of teeth 81 arranged around one end thereof and plural first limiting projections 82, 82*a*, each first limiting projection 82 has a tilted end portion 83, and between two spaced first limiting projections 82 is defined a first limit notch 84. The handle 50 includes a hollow locking member 100 formed on an inner wall thereof, and the locking member 100 has a plurality of protrusions 51 spaced apart, and each protrusion 51 has a tilted second limit notch 52 and an inclined edge 54 which are arranged on an end portion of each protrusion 51, between two spaced protrusions 51 is defined a third limit notch 53. The spring 90 has two ends abutting against the clutch ring 80 and the fixing member 41, such that the positioning torque mechanism 60 is pressed to control the torque mechanism 40.

The boss 71 of the pressing cap 70 pushes against the plurality of teeth 81 of the clutch spring 80.

The pressing cap 70 also has a peripheral trench 77 defined around the outer rim thereof, and the clutch ring 80 has a resilient piece 86 formed thereon, and the resilient piece 86 has a defining bump 85 for limiting the clutch ring 80 in the peripheral trench 77 of the pressing cap 70.

When the orifice 72 of the pressing cap 70 retains with the plurality of blocks 43 and the slot 44, the plural first limiting projections 82 of the clutch ring 80 engages with the tilted second limit notch 52 of the handle 50.

When the orifice 72 of the pressing cap 70 disengages from the plurality of blocks 43 and the slot 44, the plural first limiting projections 82 of the clutch ring 80 engages with a plurality of third limit notches 53, 53*a*, 53*b* of the handle 50.

The hollow locking member 100 is integrally formed on the handle 50.

Accordingly, in operation, the handle 50 is rotated to adjust a torque value so that the torque mechanism 40 operates, and the body 20 is rotated and drives the torque mechanism 40.

Figure 8:
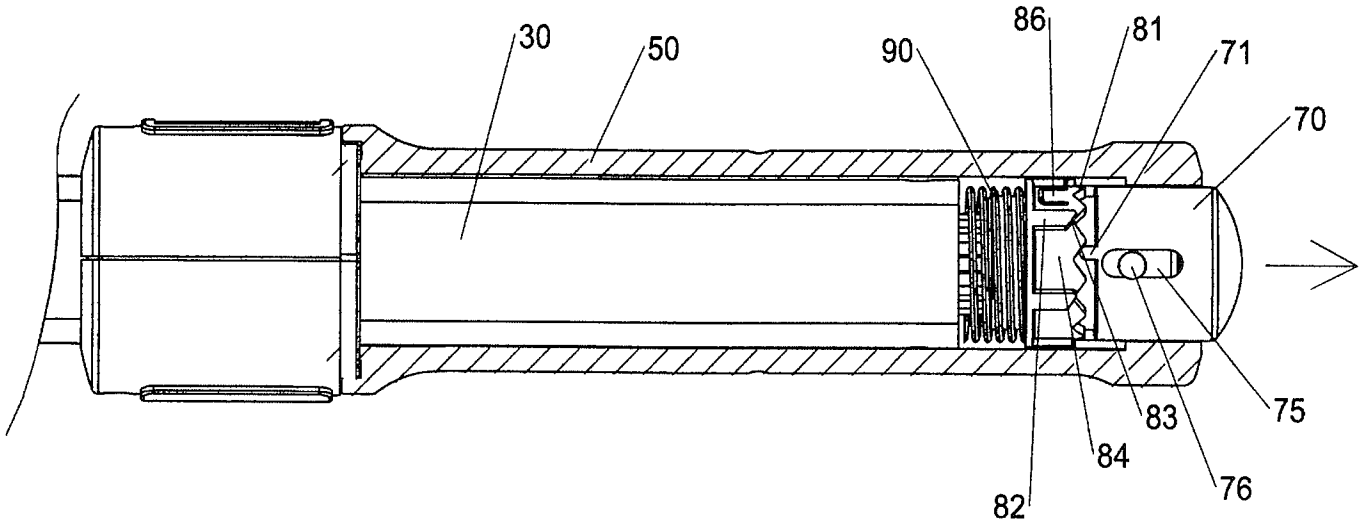
FIG. 8 is another cross sectional view showing the assembly of the positioning torque mechanism for the torque wrench according to the preferred embodiment of the present invention.
Figure 9:
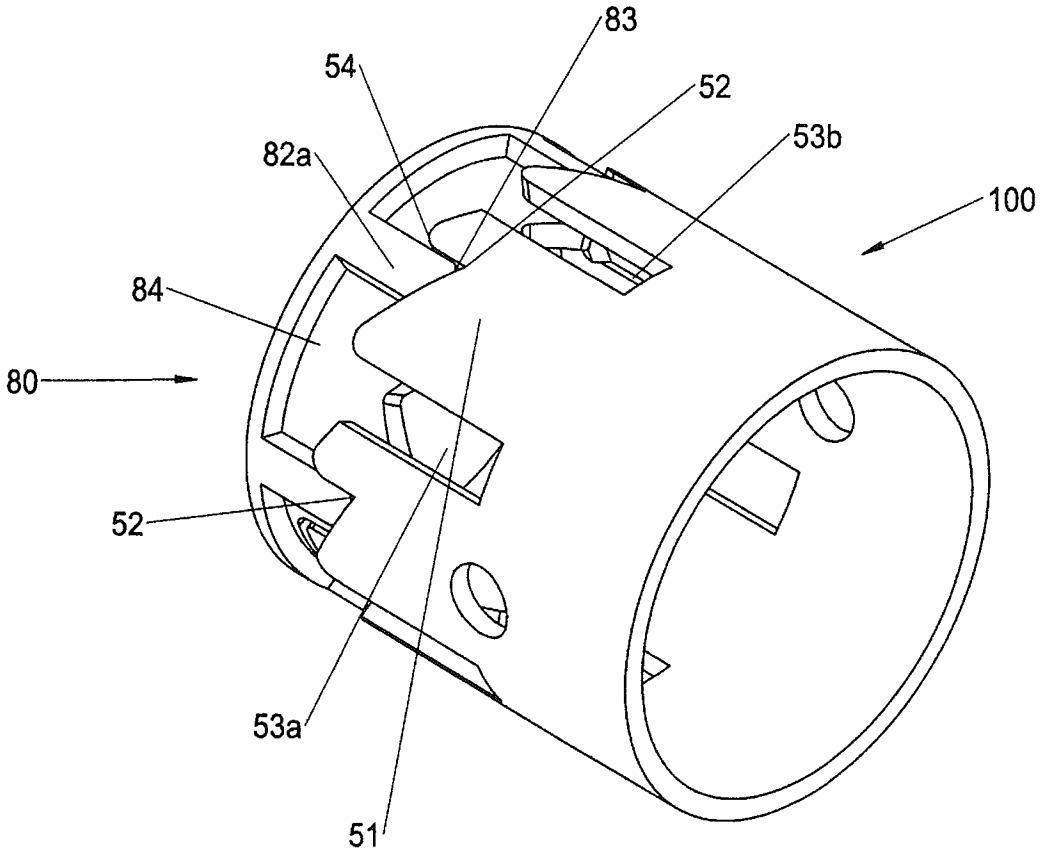
FIG. 9 is another perspective view showing the assembly of a clutch ring and a hollow locking member of the positioning torque mechanism for the torque wrench according to the preferred embodiment of the present invention.
Figure 10:
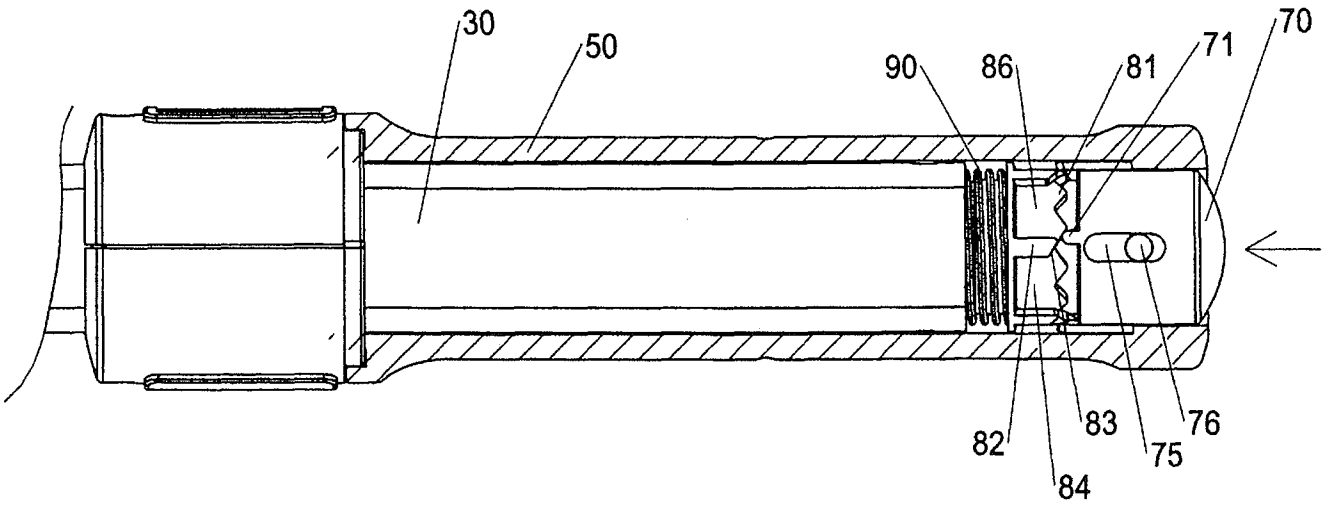
FIG. 10 is also another cross sectional view showing the assembly of the positioning torque mechanism for the torque wrench according to the preferred embodiment of the present invention.
Figure 11:
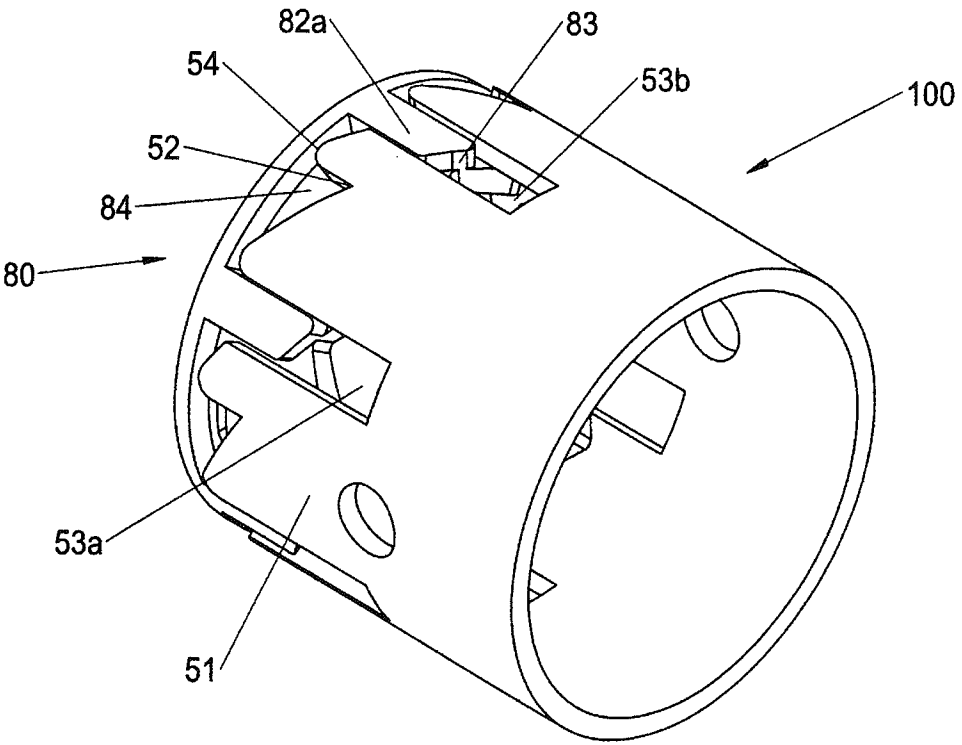
FIG. 11 is also another perspective view showing the assembly of a clutch ring and a hollow locking member of the positioning torque mechanism for the torque wrench according to the preferred embodiment of the present invention.

Referring further to FIGS. 2-5 and 6-7, when a torque value is set at a required number, the pressing cap 70 of the positioning torque mechanism 60 is pressed so that the pressing cap 70 retracts to a rear end of the handle 50. In addition, the clutch ring 80 is fitted and limited on the peripheral trench 77 of the pressing cap 70, and the boss 71 of the pressing cap 70 pushes against the plurality of teeth 81 of the clutch ring 80 so that a first limiting projection 82*a* disengages from a third limit notch 53*a* of the hollow locking member 100, and the clutch ring 80 presses the spring 90. In the meantime, the spring 90 rotates, and the pressing cap 70 retains with the plurality of blocks 43 and the slot 44 by means of the orifice 72; and then the spring 90 is pressed to push against the clutch ring 80 so that the tilted end portion 83 of the first limiting projection 82*a* slides along and retains in the tilted second limit notch 52 (as shown in FIGS. 8 and 9), thus fixing the handle 50 and keeping pre-set torque value.

With reference to FIGS. 2-5 and 10-11, when desiring to release the positioning of the torque mechanism 40, since the clutch ring 80 is fitted and limited on the peripheral trench 77 of the pressing cap 70, and the boss 71 of the pressing cap 70 pushes against the plurality of teeth 81 of the clutch ring 80 so that the first limiting projection 82*a* of the clutch ring 80 disengages from the third limit notch 53*a* of the hollow locking member 100, and the clutch ring 80 presses the spring 90 so that the spring 90 rebounds to push the clutch ring 80, and then the tilted end portion 83 of the first limiting projection 82*a* of the clutch ring 80 contacts with the inclined edge 54, thereafter the inclined edge 54 slides and limits in the third limit notch 53*a* so that the pressing cap 70 and the orifice 72 disengage from the plurality of blocks 43 and the slot 44, and the handle 50 is rotated to drive the torque mechanism 40, thereby adjusting the torque value.

Accordingly, the positioning torque mechanism of the present invention has the following advantages:

1. After setting a desired torque value, the pressing cap 70 of the positioning torque mechanism 60 is pressed easily and quickly, and the handle 50 cannot be rotated, hence the torque value cannot be changed.

2. The handle 50 is fixed without rotation so as to maintain a set torque value, thus operating the torque wrench at a fixed torque value.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A positioning torque mechanism for a torque wrench, a torque wrench comprising: a body, an extension, a torque mechanism, a handle, and a positioning torque mechanism, wherein the extension is hollow and is fitted into the handle, and the body is inserted into a front side of the extension, and the torque mechanism is inserted into a rear side of the extension, the torque mechanism includes a fixing member inserted into a screw rod, a plurality of blocks arranged around an outer rim of a rear side thereof, a slot defined between two spaced blocks, the positioning torque mechanism is placed into a rear side of the handle and connects with the fixing member, characterized in that:

the positioning torque mechanism includes a pressing cap, a clutch ring, and a spring, wherein the pressing cap has a boss defined at a predetermined position of an outer rim thereof and an orifice formed on a front end thereof, the orifice has plural shoulders arranged around an inner wall thereof and corresponding to the plurality of blocks, and between two spaced shoulders is defined a recess for corresponding to the slot, such that the pressing cap is retained with the plurality of blocks and the slot by ways of the orifice, and the pressing cap has an elongated hole defined on the outer rim thereof and a peg inserted into the elongated hole, the screw rod, and the handle so that the pressing cap slides frontward and backward on the rear side of the handle; the clutch ring is fitted on the outer rim of the pressing cap and has a plurality of teeth arranged around one end thereof and plural first limiting projections, each first limiting projection has a tilted end portion, and between two spaced first limiting projections is defined a first limit notch, the handle includes a hollow locking member formed on an inner wall thereof, and the locking member has a plurality of protrusions spaced apart, and each protrusion has a tilted second limit notch and an inclined edge which are arranged on an end portion of each protrusion, between two spaced protrusions is defined a third limit notch; the spring has two ends abutting against the clutch ring and the fixing member, such that the positioning torque mechanism is pressed to control the torque mechanism.

2. The positioning torque mechanism for the torque wrench as claimed in claim 1, wherein the boss of the pressing cap pushes against the plurality of teeth of the clutch spring.

3. The positioning torque mechanism for the torque wrench as claimed in claim 1, wherein the pressing cap also has a peripheral trench defined around the outer rim thereof, and the clutch ring has a resilient piece formed thereon, the resilient piece has a defining bump for limiting the clutch ring in the peripheral trench of the pressing cap.

4. The positioning torque mechanism for the torque wrench as claimed in claim 1, wherein when the orifice of the pressing cap retains with the plurality of blocks and the slot, the plural first limiting projections of the clutch ring engages with the tilted second limit notch of the handle.

5. The positioning torque mechanism for the torque wrench as claimed in claim 1, wherein when the orifice of the pressing cap disengages from the plurality of blocks and the slot, the plural first limiting projections of the clutch ring engages with the third limit notch of the handle.

6. The positioning torque mechanism for the torque wrench as claimed in claim 1, wherein the hollow locking member is integrally formed on the handle.

* * * * *